US005247899A

United States Patent [19]

Boesser

[11] Patent Number: 5,247,899

[45] Date of Patent: Sep. 28, 1993

[54] RAMP AND PLATFORM HARBOR ACCESS SYSTEM

[76] Inventor: Sara L. Boesser, 9365 View Dr., Juneau, Ak. 99801

[21] Appl. No.: 893,537

[22] Filed: Jun. 4, 1992

[51] Int. Cl.[5] ..... B63B 35/44

[52] U.S. Cl. ..... 114/263; 405/219

[58] Field of Search ..... 114/263, 362; 405/219, 405/220, 221; 14/27, 28, 71.1

[56] References Cited

U.S. PATENT DOCUMENTS

| | | | |
|---|---|---|---|
| 2,510,948 | 6/1950 | Beretta | 14/27 |
| 2,618,124 | 11/1952 | Holsten | 61/48 |
| 2,948,121 | 8/1960 | Karst | 61/48 |
| 3,074,241 | 1/1963 | Cahill et al. | 61/67 |
| 3,686,876 | 8/1972 | Muschell | 61/48 |
| 4,035,861 | 7/1977 | Edge | 114/263 |
| 4,260,293 | 4/1981 | Peterson | 405/219 |
| 4,335,981 | 6/1982 | Akiyama et al. | 405/221 |
| 4,352,597 | 10/1982 | Kay | 405/219 |
| 4,581,784 | 4/1986 | Rousseau | 14/71.1 |
| 4,838,735 | 6/1989 | Warner | 405/220 |
| 4,945,595 | 8/1990 | Meriweather | 14/71.1 |
| 4,990,029 | 2/1991 | Hemminger | 405/203 |
| 4,998,313 | 3/1991 | Lippka et al. | 114/263 |

FOREIGN PATENT DOCUMENTS

| | | | |
|---|---|---|---|
| 1041518 | 10/1958 | Fed. Rep. of Germany | 14/27 |
| 2405 | 1/1991 | Japan | 14/27 |

*Primary Examiner*—Michael S. Huppert
*Assistant Examiner*—Thomas J. Brahan
*Attorney, Agent, or Firm*—Christensen, O'Connor, Johnson & Kindness

[57] ABSTRACT

A shore-to-dock access system of the present invention includes an intermediate ramp 10, a buoyant platform 12, and a piling structure 13. The intermediate ramp is pivotally coupled to the shore or other fixed height structure and slidably connected to the buoyant platform. The buoyant platform then connects to a dock ramp 14, which extends to a dock 16. The buoyant platform and dock rise and fall with the water level, but the buoyant platform comes to rest on piling support structures when the water level drops sufficiently. In this manner the intermediate ramp and the dock ramp are always kept within a maximum predetermined slope suitable for wheelchair access.

18 Claims, 4 Drawing Sheets

RAMP AND PLATFORM HARBOR ACCESS SYSTEM

FIELD OF THE INVENTION

This invention pertains to a ramp and platform harbor access system; more specifically, to a system incorporating multiple floating platforms with interconnecting ramps leading to a dock below, configured so that the ramps never exceed a predetermined slope.

BACKGROUND OF THE INVENTION

The use of a single ramp from the shore to a floating dock below is a typical method of harbor access. This method usually allows some access to the dock at all tides. When the tide is high, the slope of the ramp may be gentle enough to provide access for large loads and disabled people. However, during low tide, as the dock level drops relative to the land, the slope of the ramp may be dangerous for anyone. The problem is amplified in inclement weather and with large tidal variations. In an attempt to deal with this problem, longer ramps have been used thereby reducing the ramp slope change relative to the dock level change. However, a ramp long enough to maintain a gentle slope may be infeasible due to harbor configuration, the difficulty a disabled person may have climbing such a long ramp without places to rest along the way, and the complexity and weight of such a ramp. Thus, harbor access in areas of large water-level variations can be difficult, especially for those using wheelchairs, crutches, or braces, or those carrying loads.

The maximum ideal slope for persons using wheelchairs, crutches, or braces is 4.8 degrees, i.e., 1:12 rise over run, equating to an 8.33% grade. Hence, a tidal variation of 25 feet would require a 300 foot ramp to maintain a 4.8 degree slope. Conventional harbor access ramps may not attain such a gentle slope even at highest tide.

Prior art mooring or harbor access systems designed to maintain a gentle slope with changes in water level must be manually readjusted when the water level changes more than a few feet. One typical system utilizes two interconnected ramps, the first of which extends from shore and is manually adjustable along a pencil anchor. The second ramp is pivotally connected to the first ramp on its landward end while its waterward end rides upon the floating dock. The slope of the first ramp can be manually changed to accommodate a drastic change in water level (i.e., more than a few feet). This prior art system deals with small changes in water level due to waves but cannot adequately deal with constant large changes such as tides. Manual readjustment would be a difficult and infeasible task on a body of water with a constantly and broadly changing level, such as ocean waters.

SUMMARY OF THE INVENTION

The present invention overcomes the drawbacks of conventional systems, discussed above, by providing a dock access system for controlled access between the shore and a dock for use on variable-level bodies of water. The dock access system includes at least one ramp-platform unit interconnecting the shore with a dock. Each ramp-platform unit includes a buoyant platform having waterward and landward sides; an intermediate ramp having waterward and landward ends, with the waterward end connected to the landward side of the buoyant platform; a plurality of pilings slidably connected to the buoyant platform, wherein the piling connection substantially restricts the horizontal movement of the buoyant platforms while allowing vertical movement thereof; and support structures attached to the pilings, for restricting the movement of the buoyant platform below a predetermined minimum height.

In accordance with other aspects of this invention, the intermediate ramp has a pivot connection at its landward end and a sliding connection at its waterward end. The sliding connection couples the intermediate ramp with the buoyant platform below. The pivot connection couples the intermediate ramp with the shore or another buoyant platform above.

In accordance with further aspects of this invention, the buoyant platform is constructed to ensure that the waterward end of the intermediate ramp is elevated above the landward side of the buoyant platform throughout the range of vertical travel of the platform. This aspect of the invention insures that the ramp does not "see-saw" on the landward edge of the buoyant platform when the ramp is at or near its most horizontal position. The intermediate ramp also has transition plates connected to both ends to ensure there are no severe discontinuities in level at either end of the ramp.

In a preferred embodiment of the invention, the predetermined height to which the buoyant platform is allowed to descend, and which is controlled by the support structures, is such that the maximum slope which the intermediate ramp will attain is 4.8 degrees from horizontal. Thus the dock-access system of the present invention provides for safe access for disabled persons over a wider tidal variation than would otherwise be obtainable.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
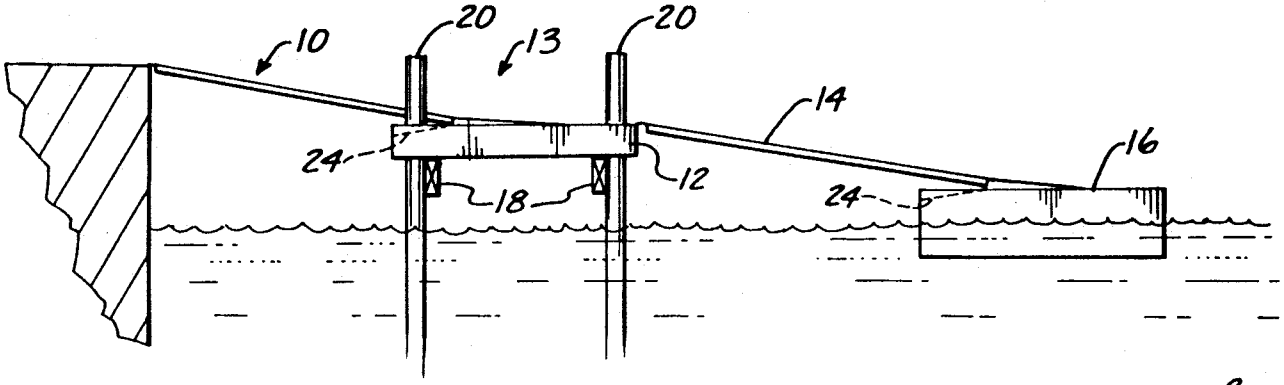
FIG. 1 is a side elevation view of a shore-to-dock access system constructed in accordance with the present invention.

With reference to FIG. 1, a first preferred embodiment of a shore-to-dock access system of the present invention includes an intermediate ramp 10, a buoyant platform 12, and a piling structure 13. As viewed from left to right in FIG. 1, the landward end of intermediate ramp 10 is pivotally coupled to the shore or other fixed height structure. The waterward end of intermediate ramp 10 rests upon the landward side of buoyant platform 12 and slides horizontally thereon as the platform rises and falls. The waterward side of buoyant platform 12 is pivotally connected to dock ramp 14, which extends to, and rests on, a floating dock 16.

Figure 2:
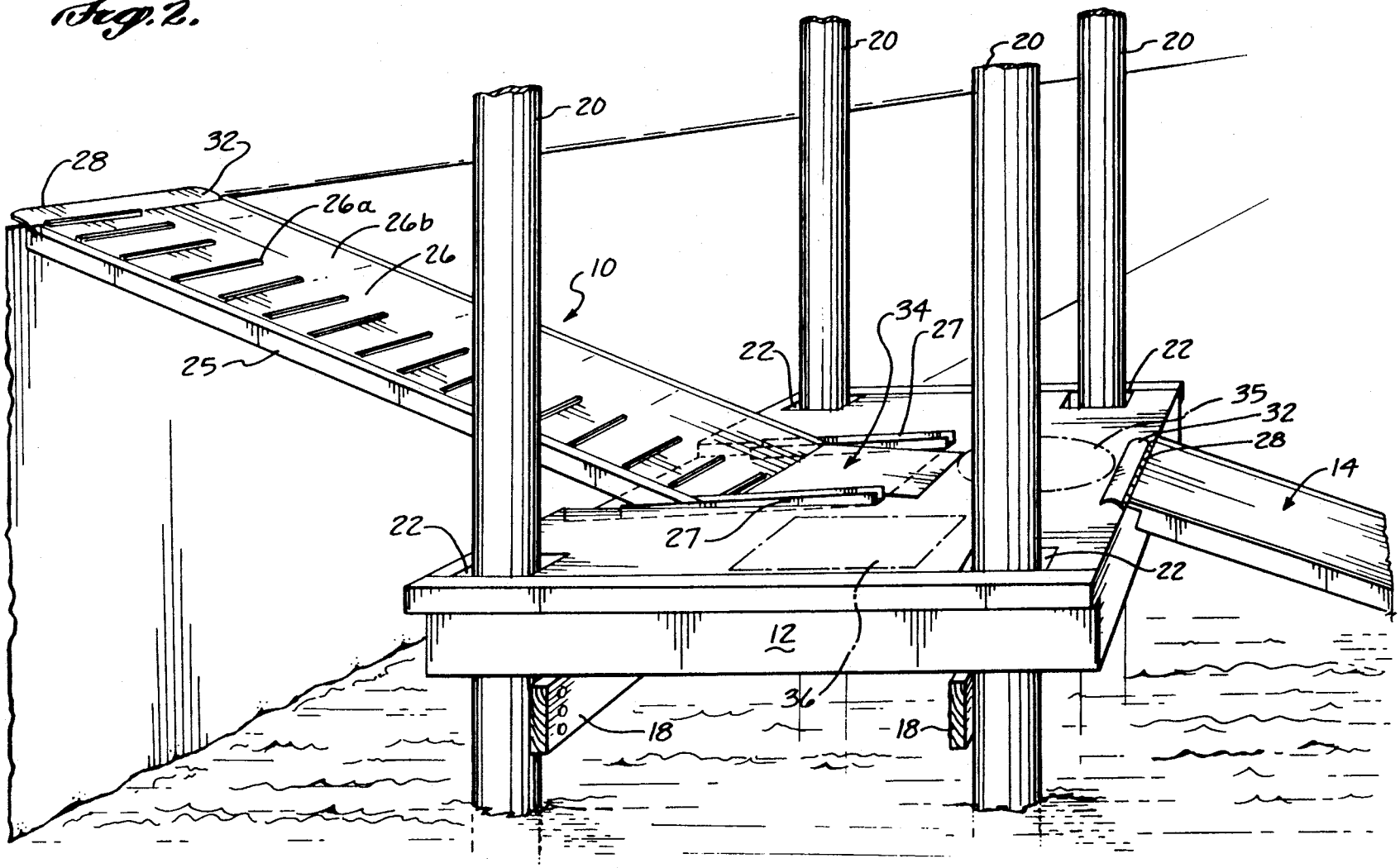
FIG. 2 is a perspective view of a ramp-platform unit supported at a minimum height by support structure beams and pilings in accordance with the present invention.

Referring to FIGS. 1 and 2, the minimum height to which buoyant platform 12 may descend is limited and maintained by piling structure 13 which includes support structures 18 mounted on pilings 20. The pilings 20 protrude through and guide the vertical movement of the buoyant platform 12, while preventing substantial horizontal movement of the platform. In the preferred embodiment illustrated, the support structures 18 are timbers secured horizontally across, and spanning between, adjacent vertical pilings 20. When the water level has dropped sufficiently, the buoyant platform 12 rests atop the support structures 18, thereby supporting the platform 12 above the water at the predetermined minimum heights. The support structures 18 may alternately be rods, bolts, collars, or other structures attached to the pilings and projecting laterally outward therefrom to support the buoyant platform 12 at a predetermined minimum height.

The shore-to-dock access system shown in FIGS. 1 and 2 is in a low tide level situation. With the water level below the support structures 18, the buoyant platform 12 rests on the support structures 18. In a preferred embodiment of the invention, the minimum height to which the support structures 18 allow the buoyant platform 12 to descend is predetermined such that the slope of the intermediate ramp 10 is less than or equal to about 4.8 degrees from horizontal. This number is dictated by considerations of safety and ability of disabled persons such as those in wheelchairs. The slope of the dock ramp 14 is also preferably kept within 4.8 degrees by the proper selection of the predetermined minimum height of buoyant platform 12 and the length of dock ramp 14. When the water level rises above the support structures 18, the buoyant platform 12 also rises as guided along the pilings 20. The pilings 20 are of sufficient height to extend above the buoyant platform 12, even at highest tide. Thus, the length of the ramps and height of support structures 18 are determined based on the expected range of water levels for a particular dock area.

The dock 16 can be any standard dock or mooring system. It may also have pilings (not shown) protruding through and guiding it as the water level changes. In a preferred embodiment of the invention, however, the dock 16 is always floating, as boats may be moored to it.

FIG. 2 illustrates a perspective view of intermediate ramp 10 and buoyant platform 12. The intermediate ramp-buoyant platform combination makes up a ramp-platform unit. The pilings 20 protrude through boxouts 22 near the corners of the buoyant platform 12. These boxouts may be rectangular, rounded, or another suitable shape.

The ramp 10 and platform 12 are constructed to ensure that the waterward edge of the ramp 10 is always elevated above the landward edge of the platform 12 throughout the full range of vertical travel of the platform 12. This ensures that the ramp 10 does not ride, or "see-saw," on the landward edge of the platform 12 when the platform 12 floats at or near its highest position, thus preventing the ramp 10 from being positioned at an incline relative to the shore or landward structure. One preferred method of achieving this goal is illustrated in FIG. 2. The landward side of the buoyant platform 12 has a cutaway section 24 defining a recess in the upper surface of the buoyant platform 12, in proximity to the platform's landward side. The tip of the waterward end of the intermediate ramp 10 rests within the cutaway section 24 at low tides. This cutaway section 24 defines an inner surface that slopes downward toward the landward side of buoyant platform 12 to allow the intermediate ramp 10 to lie flat without see-sawing on the landward side of buoyant platform 12 at higher tides. The depth of the cutaway section 24 at the landward side of the platform 12 is greater than the thickness of the ramp 10. Thus the waterward end of the intermediate ramp 10 is received within the cutaway section 24 when the intermediate ramp 10 is at a horizontal or slightly negative slope. At low tides, the tip of the waterward end of the intermediate ramp 10 rests within the cutaway section 24 as illustrated in FIG. 2.

The ramp 10 includes a frame formed by longitudinal, parallel side rail members 25 that are spaced by transverse frame members (not shown) which support an upper deck 26. Walking cleats 26(*a*) are preferably formed on one side of the upper deck 26 for foot traffic; an uncleated surface portion 26(*b*) at least 36" wide is provided on the other side of the upper deck 26 for wheelchair access, dollies for loads, use of crutches, etc. Closed-cell foam floats or other buoyant members are secured to the underside of buoyant platform 12 in the conventional manner to render the platform 12 positively buoyant at all times during use. The buoyant platform 12 includes spaced parallel guide channels 27 that are affixed to opposite edges of the sloping surface of cutaway section 24. In a preferred embodiment of the present invention, these guide channels are constructed of metal, such as steel. The guide channels 27 have a wide "U" cross-sectional shape which is upwardly opening to interface with the bottom portion of the waterward end of the side rails 25 of intermediate ramp 10. As the buoyant platform 12 rises and falls with changing water levels, the waterward end of intermediate ramp 10 glides within these guide channels 27, thereby preventing the intermediate ramp from moving side-to-side across the buoyant platform. These channels 27 extend landward only far enough to service ramp 10 at lowest tides. Cutaway 24 continues landward behind and below channels 27 to prevent ramp 10 from rocking on the landward edge of platform 12 at high tides when ramp 10 is in an approximately horizontal position.

A hinge 28 is attached to the waterward side of buoyant platform 12. This hinge 28 pivotally connects the dock ramp 14 with the buoyant platform 12. Another hinge (not shown) pivotally connects the intermediate ramp 10 with the land.

Upper transition plates 32 make for a smooth transition onto intermediate ramp 10 or dock ramp 14 from either the shore or buoyant platform 12, respectively, to which the ramp is connected on its landward end. The upper transition plates 32 are each arched upwardly and are pivotally connected to the associated shore or buoyant platform 12 and slidably connected to the landward end of the associated ramp 10 or 14.

Lower transition plates 34 make for a smooth transition from intermediate ramp 10 or dock ramp 14 to either the buoyant platform 12 or to the dock 16 to which the ramp is connected on its waterward end. This lower transition plate 34 is pivotally connected to the waterward end of the ramp 10 or 14 and slidably connected to the associated buoyant platform 12 or dock 16. A preferred embodiment of the transition plate 34 is made of metal, such as steel, of sufficient length to maintain a maximum 1:12 slope from ramp 10 to platform 12 even at highest tides. The waterward edge of plates 34 should not exceed ½" in thickness to accommodate wheelchair access.

For optimal use of the ramp/platform system by persons using wheelchairs, platform 12 ideally defines an unobstructed surface portion 35 between transition plates 34 and 32 of at least about five feet in diameter to accommodate the turning of wheelchairs. Also, adjacent to the surface portion 35 is preferably a surface portion 36 measuring at least three feet wide by four feet long to provide a pull-out resting place for a person using a wheelchair or carrying heavy loads. A bench not encroaching on surface portions 35 or 36 (not shown) would also be desirable.

Figure 3:
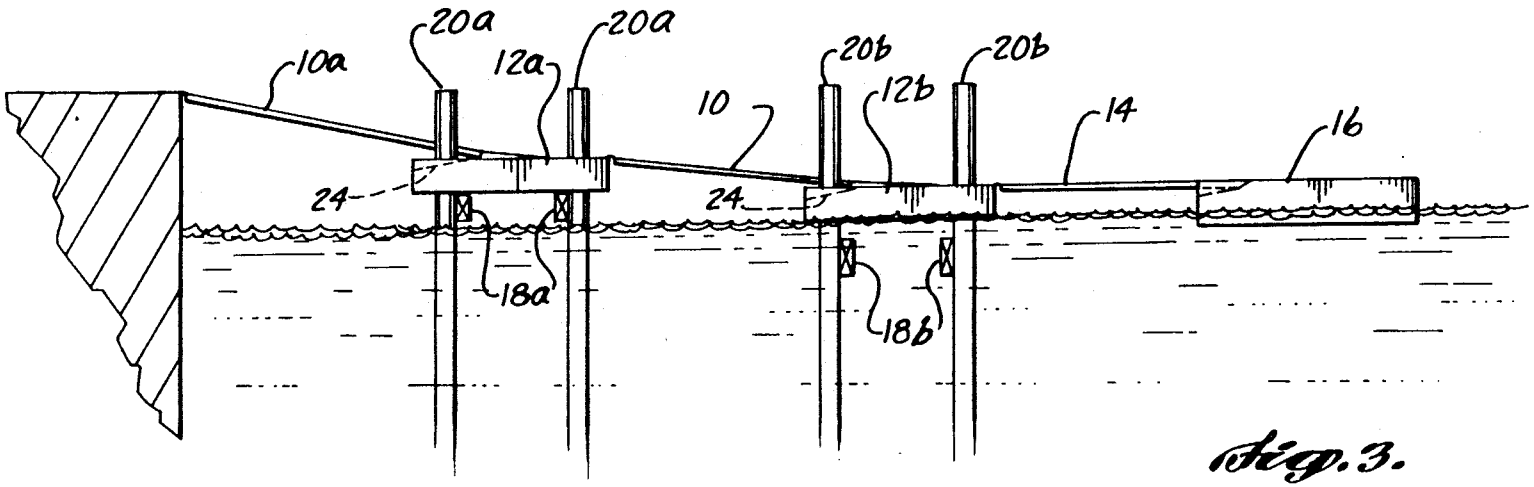
FIG. 3 is a side elevation view of an alternate embodiment of a shore-to-dock access system constructed in accordance with the present invention and including two platforms with the waterward-most platform floating.

With reference to FIG. 3, an alternate embodiment of a shore-to-dock access system of the present invention includes a second ramp-platform unit. A portion of this alternate shore-to-dock access system is constructed similarly to the previously described system, and similar elements are thus identified with the same part numbers, to which the suffixes "a" and "b" have been added. Along with the intermediate ramp 10*a*, buoyant platform 12*a*, dock ramp 14, dock 16, support structures 18*a*, and pilings 20*a*, the second ramp platform unit includes a second intermediate ramp 10*b*, second buoyant platform 12*b*, second support structures 18*b*, and second pilings 20*b*. Second intermediate ramp 10*b*, second buoyant platform 12*b*, second support structures 18*b*, and second pilings 20*b* are similarly constructed to the corresponding components of the previously described system.

It should be apparent that any number of ramp-platform units could be interconnected in the manner illustrated in FIG. 3 to meet a particular harbor's access requirements. For example, shore-to-dock access systems can be constructed with three or more ramp-platform units.

The illustrated shore-to-dock access system has an essentially linear configuration from the shore to the dock 16. However, it is understood that the shore-to-dock access system can be configured with turns, if necessary, to conform to the requirements of most any specific harbor approach. In this manner, peculiarities of individual harbors can be taken into account and taken advantage of. For example, it may be possible to use some pre-existing pilings in constructing the shore-to-dock access system of the present invention.

The operation of the shore-to-dock access system is illustrated in FIG. 3, which shows the waterward-most buoyant platform 12*b* floating above its corresponding support structures 18*b*, while the buoyant platform 12*a* is held above the water level. At that water level, dock ramp 14 is substantially horizontal, and the intermediate ramp 10*b* is within the predetermined maximum slope with its waterward end resting on the landward side of buoyant platform 12*b*. In this configuration, the slope of the intermediate ramp 10*a* is at its maximum predetermined slope. If the water level were to rise, the landward-most buoyant platform 12*a* would also float above its corresponding support structures 18*a*. Alternatively, if the water level were to fall below the level shown, the waterward-most platform 12*b* would eventually rest on its support structures 18*b*, and at lowest tide or lowest water level the slope of all ramps 10*a*, 10*b*, and 14 would be at or within the maximum predetermined slope. It can therefore be appreciated that at all water levels the ramps can all be kept within a predetermined slope. Thus, according to the above and utilizing the system on ocean waters, the buoyant platforms 12 and dock 16 rise and fall with the tide, but one by one the buoyant platforms 12 come to rest on piling support structures as the tide drops. In this manner the intermediate and dock ramps (10 and 14) are always kept within a maximum predetermined slope suitable for wheelchair access.

The previous preferred embodiment of a buoyant platform 12 was described and illustrated in FIG. 2 as including a sloped recess 24 to prevent intermediate ramp 10 from riding on the landward edge of the platform 12 when ramp 10 is at or near its most horizontal position. Rather than including a sloped recess 24, the buoyant platform can be constructed without a recess, having a generally planar upper surface, with other accommodations being made to raise the waterward end of the intermediate ramp 10 relative to the landward side-edge of the buoyant platform. In this manner, the portion of the intermediate ramp 10 proximate the waterward end is spaced above, rather than resting upon, the landward side-edge of the buoyant platform.

Figure 4A:
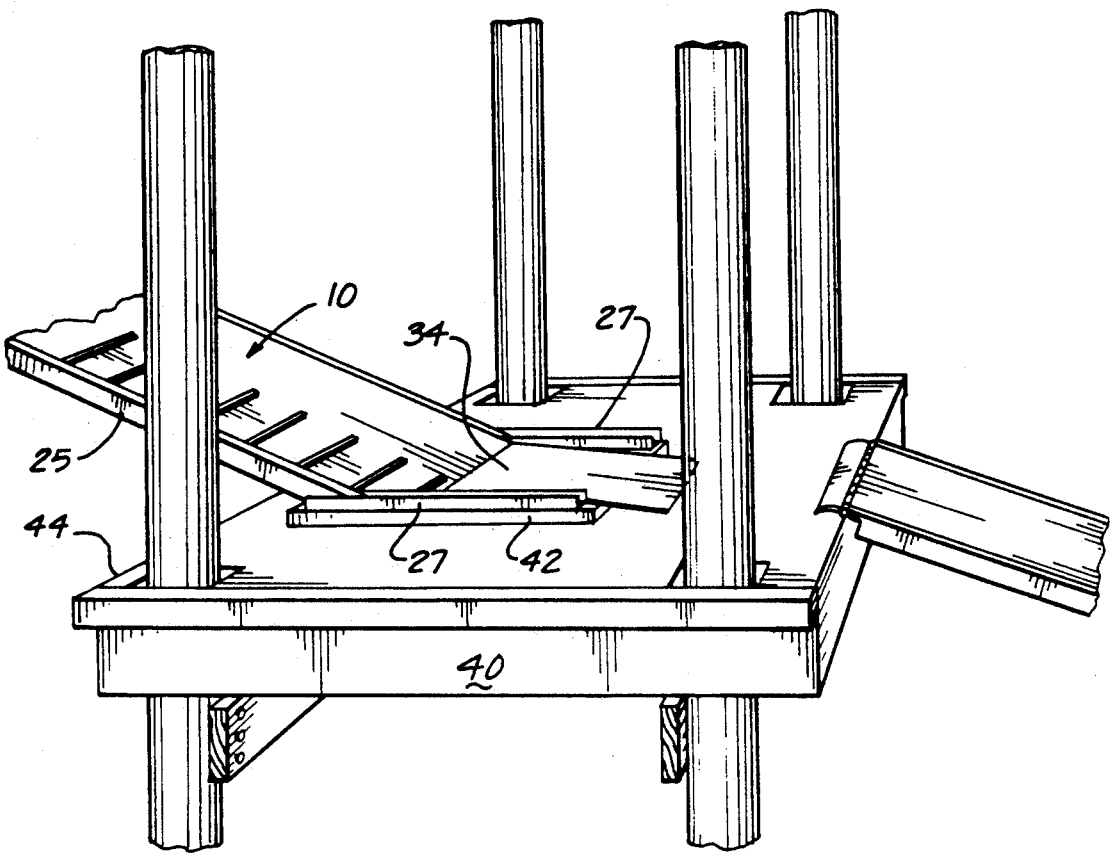
FIG. 4A is a partial pictorial view of an alternate embodiment of a ramp-platform unit, wherein the waterward edge of the intermediate ramp is supported above the upper surface of the buoyant platform.
Figure 4B:
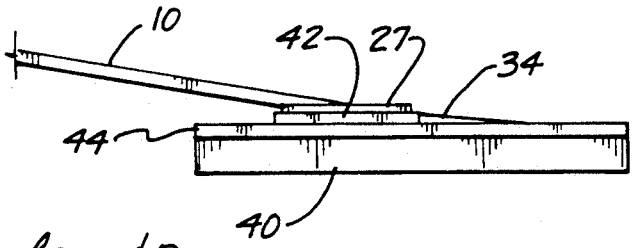
FIGS. 4B and 4C are partial side elevation views of the ramp-platform unit of FIG. 4A, with the platform in its lowest and highest positions, respectively.
Figure 4C:
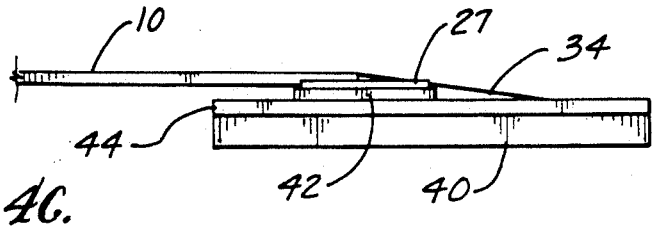

One such alternate embodiment is shown in FIGS. 4A–4C. A buoyant platform 40 includes a planar upper surface, and is identical to previously described buoyant platform 12 with the exception that there is no recess 24. Instead, parallel guide channels 27 are mounted on a spacer block 42 to the upper surface of the platform 40. The block 42 serves to raise channels 27, and thus the waterward ends of side rail members 25 of the intermediate ramp 10, above the nominal upper surface of platform 40. As shown in FIG. 4A, both guide channels 27 and block 42 are spaced away from the landward edge 44 of the platform 40.

Although a single unitary block 42 is illustrated, it should be apparent to those of skill in the art that separate blocks could be disposed between corresponding guide channels 27 and the upper surface of platform 40. As shown in FIG. 4B, when the buoyant platform 40 is at its lowest elevation, the intermediate ramp 10 is sloped downwardly toward the platform 40, with the ramp 10's waterward edge being supported on the block 42. Lower transition plate 34 provides for a smooth transition from intermediate ramp 10, over block 42, to platform 40. When platform 40 floats upwardly toward its highest elevation (FIG. 4C), block 42 ensures that the intermediate ramp 10 is maintained at an approximately horizontal position, and is spaced above the landward edge 44 of the platform 40.

Figure 5A:
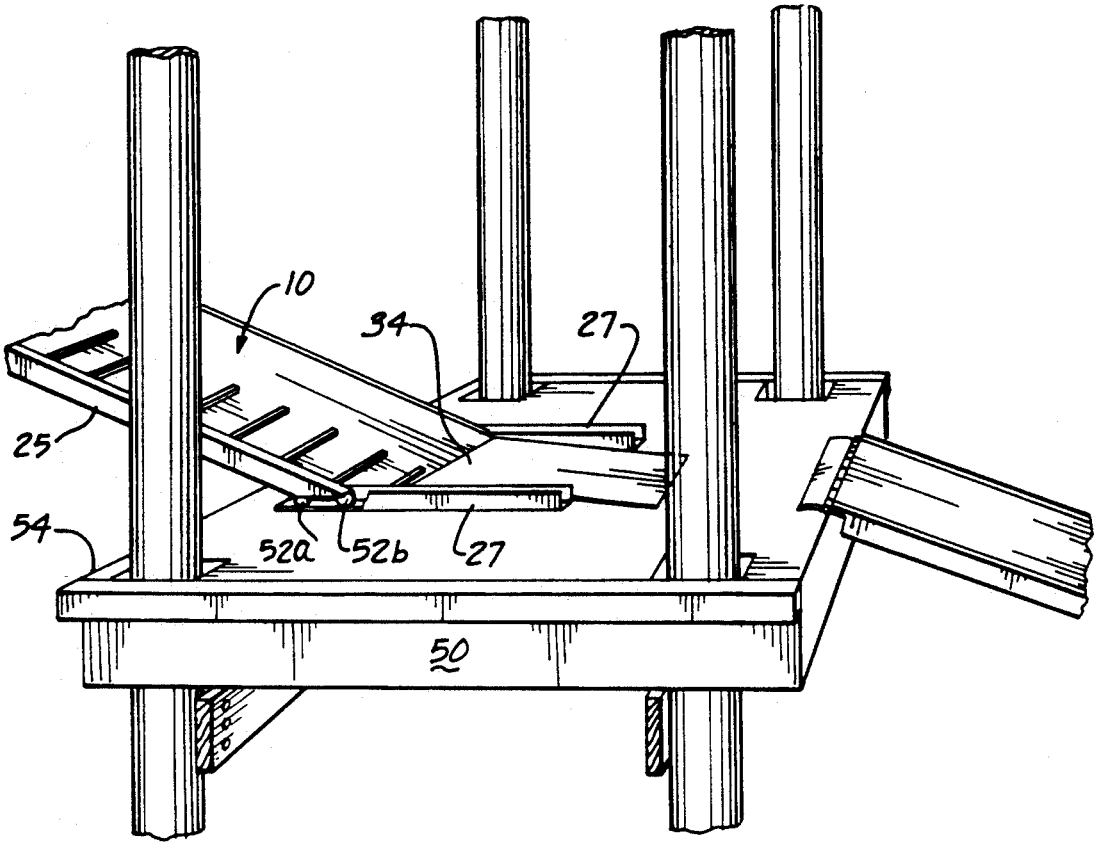
FIG. 5A is a partial pictorial view of another alternate embodiment of a ramp-platform unit, wherein lifts are included on the bottom surface of the waterward edge of the ramp.
Figure 5B:
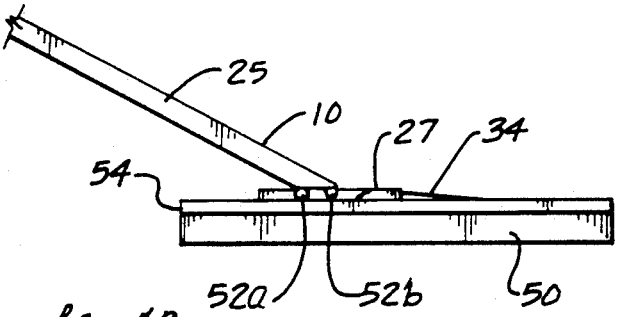
FIGS. 5B and 5C are partial side elevation views of the ramp-platform unit of FIG. 5A, with the platform in its lowest and highest positions, respectively.
Figure 5C:
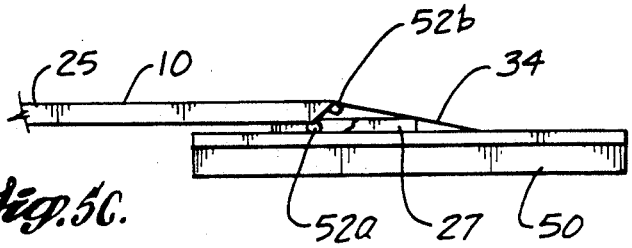

Another alternate embodiment of an intermediate ramp and buoyant platform construction to prevent see-sawing of the ramp is illustrated in FIGS. 5A–5C. The buoyant platform 50 shown in FIG. 5A is identical to buoyant platform 40, except that guide channels 27

(shown partially broken away in FIGS. 5A-5C) are mounted directly on the upper surface of platform 50, rather than being elevated above the upper surface. Again, no sloped recess is included, with the upper surface of platform 50 being generally planar. However, two lifts 52*a* and 52*b* are secured to the bottom of the waterward end of each side rail member 25 of intermediate ramp 10. Each lift 52 may comprise a transverse rod or other structure having a rounded bottom surface. When the side rail members 25 are constructed of steel, as is common practice, the lifts 52 are preferably welded to the bottom surface of the side rail members 25. The lifts 52 are dimensioned such that they are received within the corresponding guide channels 27.

As shown in FIG. 5B, when the platform 50 is at its lowest elevation, both lifts 52*a* and 52*b* on each side rail member 25 contact and slide within the corresponding guide channel 27. When platform 50 floats to near its highest position (FIG. 5C), only the landward lift 52*a* contacts the bottom of corresponding guide channel 27. In this position, the intermediate ramp 10 pivots and slides on the landward lift 52*a*. The height of the lifts 52*a* are determined to ensure that the platform 10 is raised above the landward edge 54 of the platform 50 when intermediate ramp 10 is in an approximately horizontal position at the highest elevation of the buoyant platform 50. Although first and second lifts 52*a* and 52*b* have been illustrated and described, it should be apparent to those of skill in the art that a single lift or protuberance could be formed on the bottom of the waterward end of each side rail member 25, with the intermediate ramp 10 being supported by and pivoting on the lift at various elevations.

While preferred embodiments of the invention have been illustrated and described, it will be appreciated that various changes can be made therein without departing from the spirit and scope of the invention. For example, as mentioned earlier, the configuration of the system can be changed to include turns to fit with the configuration of a particular harbor. Further, additional ramp-platform units could be interconnected between the shore and the dock ramp, providing for gentler slopes or perhaps accommodating a larger tidal range. It should also be appreciated that the shore-to-dock access system of the present invention can be used in most any situation requiring access to variable-level bodies of water (e.g., lakes, reservoirs, rivers, and oceans). Finally, it should be clear that the shore-to-dock access system of the present invention can connect any fixed level object, designated as "shore" herein, with a "dock" below. Consequently, the invention can be practiced otherwise than as specifically described herein.

The embodiments of the invention in which an exclusive property or privilege is claimed are defined as follows:

1. An intermediate platform system for use in a shore-to-dock access system, including a floating dock and an associated dock ramp, the intermediate platform system comprising:

(a) a buoyant platform having an upper surface, a landward side and a waterward side, said waterward side being pivotally connected to the dock ramp;

(b) an intermediate ramp having a landward end and a waterward end and extending from a structure having a fixed height to said buoyant platform, said waterward end being unconnected to and slidably supported by a supporting surface of said landward side of said buoyant platform and said landward end being pivotally connected to said structure having a fixed height; and (c) a piling system slidably connected to said buoyant platform for supporting said buoyant platform at a predetermined height while allowing said buoyant platform to float freely above said predetermined height; whereby the maximum slope of said intermediate ramp is fixed by said piling system and said structure.

2. The intermediate platform system of claim 1, wherein the piling system comprises:

a plurality of pilings; and a plurality of support structures fixed to said pilings, such that said buoyant platform is supported by said support structures at said predetermined height.

3. The intermediate platform system of claim 1, wherein said buoyant platform supports both the dock ramp and said intermediate ramp coupled to said buoyant platform while maintaining an approximately level orientation at all times.

4. The intermediate platform system of claim 1, further comprising means for maintaining said waterward end of said intermediate ramp at an elevation above said supporting surface of said buoyant platform on which said waterward end of said intermediate ramp slides as the buoyant platform floats between said predetermined height and a highest position.

5. The intermediate platform system of claim 4, wherein said means for maintaining said waterward end of said intermediate ramp comprises a section of said upper surface of said buoyant platform that defines a recess in proximity to said buoyant platform's landward side, wherein said recess receives said waterward end of said intermediate ramp when said buoyant platform floats to a predetermined minimum slope.

6. The intermediate platform system of claim 4, wherein said means for maintaining said waterward end of said intermediate ramp comprises a spacer member supporting said waterward end of said intermediate ramp above an upper surface of said buoyant platform.

7. The intermediate platform system of claim 1, wherein said piling system is configured relative to the structure so as to maintain the slope of said intermediate ramp at no greater than about 4.8 degrees from horizontal.

8. A dock-access system for use on a variable level body of water for access between a fixed height structure and a dock and dock ramp structure, the dock-access system including at least one ramp-platform unit interconnecting the shore with the dock ramp, wherein the ramp-platform unit comprises:

(a) a first buoyant platform having an upper surface, a waterward side pivotally connected to the dock ramp, and a landward side;

(b) a first intermediate ramp having a waterward end and a landward end and extending from the fixed height structure to said buoyant platform, wherein said waterward and is unconnected to and slidably supported by a supporting surface of said landward side of said buoyant platform and said landward end is pivotally connected to the fixed height structure;

(c) a plurality of first piling slidably connected to said first buoyant platform, wherein said first pilings substantially restrict the horizontal movement of said first buoyant platform while allowing vertical movement of said first buoyant platform; and (d) support structures attached to said first pilings, wherein said support structures restrict the movement of said first buoyant platform below a predetermined minimum height.

9. The dock-access system of claim 8, wherein the predetermined minimum height to which said first buoyant platform is allowed to descend is such that the maximum slope which said first intermediate ramp will attain is 4.8 degrees from horizontal.

10. The dock-access system of claim 8, wherein said first intermediate ramp is pivotally connected at its landward end and is slidably connected at its waterward end.

11. The intermediate platform of claim 10, further comprising means for maintaining said waterward end of said first intermediate ramp at an elevation above said supporting surface of said first buoyant platform on which said waterward end of said intermediate ramp slides as the first buoyant platform floats between said predetermined height and a highest position.

12. The dock access system of claim 11, wherein said means for maintaining said waterward end of said first intermediate ramp comprises a section of said upper surface of said first buoyant platform that defines a recess for receiving said waterward end of said first intermediate ramp to fit in when the slope of said first intermediate ramp is at or below a predetermined minimum slope.

13. The intermediate platform system of claim 11, wherein said means for maintaining said waterward end of said first intermediate ramp comprises a spacer member supporting said waterward end of said first intermediate ramp above an upper surface of said first buoyant platform.

14. The dock access system of claim 8, further comprising:

(a) a second buoyant platform having a waterward side connected to the landward end of said first intermediate ramp and a landward side;

(b) a second intermediate ramp having a waterward end connected to the landward side of said second buoyant platform and a landward end connected to a fixed height structure; and (c) a plurality of second pilings slidably connected to said second buoyant platform, wherein said second pilings substantially restrict the horizontal movement of said second buoyant platform while allowing vertical movement of said second buoyant platform; and (d) support structures attached to said second pilings, wherein said support structures restrict the movement of said second buoyant platform below a predetermined minimum height.

15. A dock-access system for use on a variable level body of water for access between a fixed height structure and a dock and dock ramp structure, the dock-access system including at least one ramp-platform unit interconnecting the shore with the dock ramp, wherein the ramp-platform unit comprises:

(a) a first buoyant platform having a waterward side and a landward side, said waterward side being pivotally connected to the dock ramp;

(b) a first intermediate ramp having a waterward end and a landward end and extending from the fixed height structure to said first buoyant platform, wherein said waterward end is unconnected to and slidably supported by a surface of said landward side of said buoyant platform and said landward end is pivotally connected to the fixed height structure; and (c) support means slidably connected to said first buoyant platform for supporting said buoyant platform, wherein said support means restricts the vertical movement of said first buoyant platform below a predetermined minimum height and substantially restricts the horizontal movement of said first buoyant platform.

16. A dock-access system for use on a variable level body of water for access between a fixed height structure and a dock and dock ramp structure, the dock-access system including at least one ramp-platform unit interconnecting the shore with the dock ramp, wherein the ramp-platform unit comprises:

(a) a first buoyant platform having an upper surface, a waterward side and a landward side, said waterward side being pivotally connected to the dock ramp;

(b) a first intermediate ramp having a waterward end and a landward end and extending from the fixed height structure to said first buoyant platform, wherein said waterward end is unconnected to and slidably supported by a supporting surface of said landward side of said buoyant platform and said landward end is pivotally connected to the fixed height structure; and (c) means for maintaining said waterward end of said intermediate ramp at an elevation above said supporting surface of said buoyant platform on which said waterward end of said intermediate ramp slides as the buoyant platform floats between a minimum height and maximum height.

17. The dock access system of claim 16, wherein said means for maintaining said waterward end of said first intermediate ramp comprises a section of said upper surface of said first buoyant platform that defines a recess for receiving said waterward end of said first intermediate ramp to fit in when the slope of said first intermediate ramp is at or below a predetermined minimum slope.

18. The intermediate platform system of claim 16, wherein said means for maintaining said waterward end of said first intermediate ramp comprises a spacer member supporting said waterward end of said first intermediate ramp above an upper surface of said first buoyant platform.

* * * * *

UNITED STATES PATENT AND TRADEMARK OFFICE

CERTIFICATE OF CORRECTION

PATENT NO. : 5,247,899

DATED : September 28, 1993

INVENTOR(S) : S. L. Boesser

It is certified that error appears in the above-indentified patent and that said Letters Patent is hereby corrected as shown below:

| COLUMN | LINE | |
|---|---|---|
| 8 (Claim 8, | 61 Line 13) | "waterward and" should read --waterward end-- |

Signed and Sealed this

Fifth Day of April, 1994

Bruce Lehman

*Attest:*

BRUCE LEHMAN

*Attesting Officer*

*Commissioner of Patents and Trademarks*